US005592705A

United States Patent [19]

West

[11] Patent Number: 5,592,705

[45] Date of Patent: Jan. 14, 1997

[54] IMPACT CUSHIONING DEVICE TO PREVENT FALL RELATED INJURIES

[76] Inventor: Raymond O. West, Box 1137, Belfair, Wash. 98528

[21] Appl. No.: 394,447

[22] Filed: Feb. 27, 1995

[51] Int. Cl.[6] ..... A47C 21/08

[52] U.S. Cl. ..... 5/424; 5/58; 182/137

[58] Field of Search ..... 5/93.1, 600, 17 T, 5/181, 185, 424, 658; 182/137

[56] References Cited

U.S. PATENT DOCUMENTS

| | | | |
|---|---|---|---|
| 2,607,052 | 8/1952 | Le Roy | 5/93.1 |
| 2,608,696 | 9/1952 | Le Roy | 5/93.1 X |
| 2,696,620 | 12/1954 | Le Roy | 5/93.1 X |
| 4,106,138 | 8/1978 | Murphy | 5/181 |
| 5,052,065 | 10/1991 | West | 5/424 |
| 5,150,767 | 9/1992 | Miller | 182/137 |
| 5,203,427 | 4/1993 | Williams, Sr. et al. | 182/137 X |

*Primary Examiner*—Michael F. Trettel

*Attorney, Agent, or Firm*—Christensen, O'Connor, Johnson & Kindness

[57] ABSTRACT

This invention relates to an impact cushioning device for protecting bed occupants from fall-related injuries. The cushioning device generally comprises an inflatable air cushion or a variety of other impact absorbing materials. The impact absorbing cushion is stowed adjacent to the bed and adapted to rapid displacement when weight of the occupant is removed from the bed. The impact cushioning device is oriented to the bed in a manner wherein the cushion creates a barrier between the bed occupant and the floor when displaced.

9 Claims, 2 Drawing Sheets

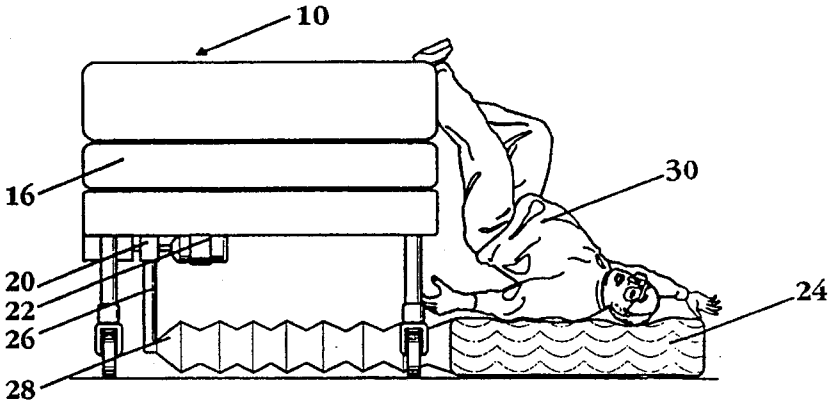
Fig. 1B
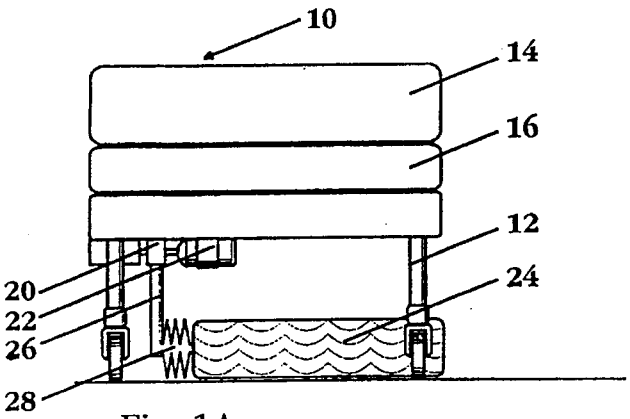
Fig. 1A
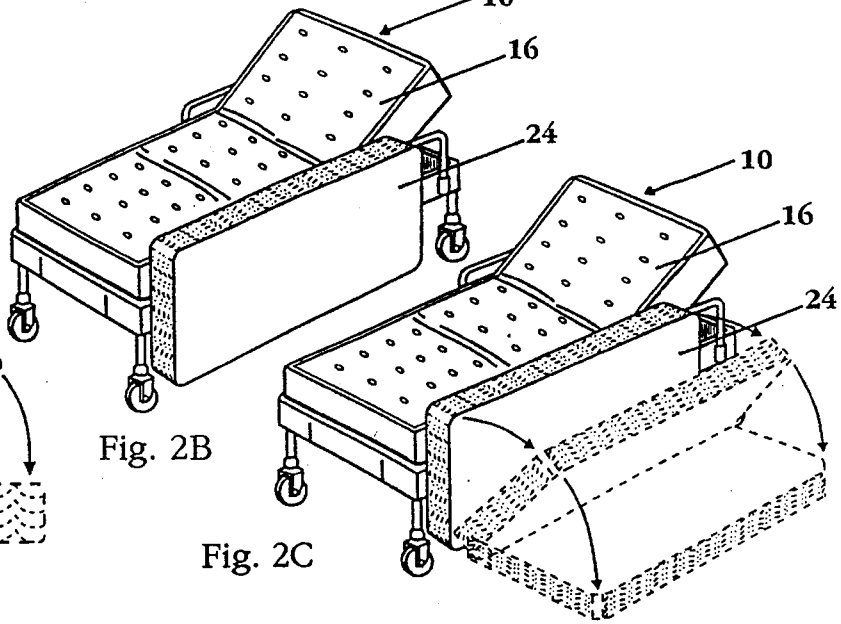
Fig. 2B
Fig. 2C
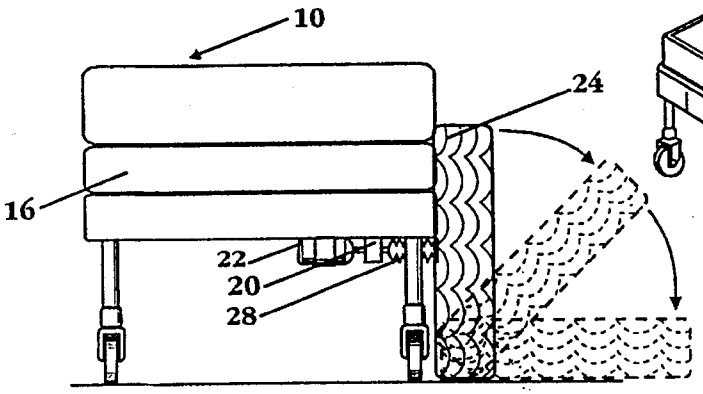
Fig 2A

IMPACT CUSHIONING DEVICE TO PREVENT FALL RELATED INJURIES

FIELD OF INVENTION

The invention relates generally to medical safety equipment and more particularly to an impact cushioning device for protecting bed occupants, or the like, from injuries related to falls.

BACKGROUND—FIELD OF INVENTION

It is common knowledge to the medical and nursing profession that patients are frequently traumatized by falls from bed, both in hospitals and nursing homes. While it is not impossible to restrain patients in beds either by tying or by drugs, these methods have deleterious repercussions. These include mental and physical trauma; both producing extreme discomforts.

All to frequently, falls follow confusion and deliberate attempts to leave the bed even by climbing over side-rails. These bed related falls are frequently linked to confusion caused by the unfamiliar hospital or nursing home environment. Currently used beds include safety mechanisms, like side-rails, yet all such devices, including restraints, are not capable of cushioning impact when an individual falls from bed to floor. Thus a need exists for an impact cushioning device attachable to hospital and nursing home beds. Billions of scarce health-care dollars are expended annually to repair fractured hips and the like. Twenty percent of elderly patients who break a hip are dead within 2 months and 50% never walk again.

U.S. Pat. No. 5,172,683 to West 1992 discloses a means whereby a cushioning air-bag is filled with gas stored under pressure in a canister. Using current technology, the expense of this embodiment is prohibitive and thus inappropriate in today's health care fiscal climate.

SUMMARY OF THE INVENTION

According to the embodiment of the present invention, there is provided an impact cushion device for the prevention of a bed occupant from fall related injury. The cushioning device of the embodiment may be attached to a bed having a mattress portion and a frame portion.

PRESSURE SENSING MEANS

At least one pressure sensing means is disposed in the mattress portion of the bed, the pressure sensing means being operable to generate a signal when pressure is removed therefrom. The preferred pressure sensing means comprises plural pressure sensitive switches disposed within or on the surface of the mattress. Also provided is a means of displacing a stowed impact cushioning device so that it will intervene between the falling patient and the floor. The displacing means which is connected to the frame portion of the bed is responsive to the signal generated by the sensing means. A switch means is also provided for selectively activating and deactivating the sensing means. The impact cushioning device is preferably related to the frame portion in a manner wherein the impact cushioning device will displace outwardly from the bed so as to create a barrier between bed occupant and the floor when the occupant falls from the side or end portion of the bed.

The displacement means comprises a canister containing a supply of compressed gas therein which is fluidly connected to a valve mechanism disposed between the canister and one or more bellows which when filled with gas, expand(s) longitudinally. By this means the cushion is displaced and thus deployed between the falling patient and the floor. The valve mechanism is normally closed whereby the compressed gas is retained within the canister and operable to an open position whereby compressed gas is free to flow from the canister into the bellows. The pressure sensing means is electrically connected to the valve mechanism and the signal generated from pressure sensing means is operable to actuate the valve mechanism from its closed position to an open position. In this respect, the signal is generated when pressure is removed from all of the pressure sensitive switches comprising the pressure sensing means. At least one cushioning device is stowed relative to the frame portion of the bed.

It is therefore, an object of the present invention to provide an impact cushioning device for automatically protecting patients from injuries that occur during falls from beds.

Another object of the present invention is to provide an impact cushioning device which is passive in operation and thereby reduces the need for extended periods of forcible restraint of patients within hospital and nursing home beds.

Another object of the present invention is to provide an impact cushioning device which allows mobility for bed occupants without fear of falling and consequent injury thereto.

BRIEF DESCRIPTION OF THE DRAWINGS

These, as well as other features of the present invention will become more apparent upon reference to the drawings wherein:

FIG. 1A is an end view of a patient bed incorporating an impact cushioning device stowed beneath the bed, poised for instant displacement.

FIG. 1B is an end view of a patient bed illustrating the manner in which the impact cushioning device is displaced to the side of the bed, ready to cushion the fall of the bed occupant.

FIG. 2A is an end view of a patient bed illustrating an alternate means of deploying an impact cushioning device which, prior to activation is stowed beside the bed and displaced to intervene between falling patient and the floor.

FIGS. 2B & C are perspective views submitted to further clarify FIG. 2A.

DETAILED DESCRIPTION OF THE PREFERRED EMBODIMENT

Figure 3B:
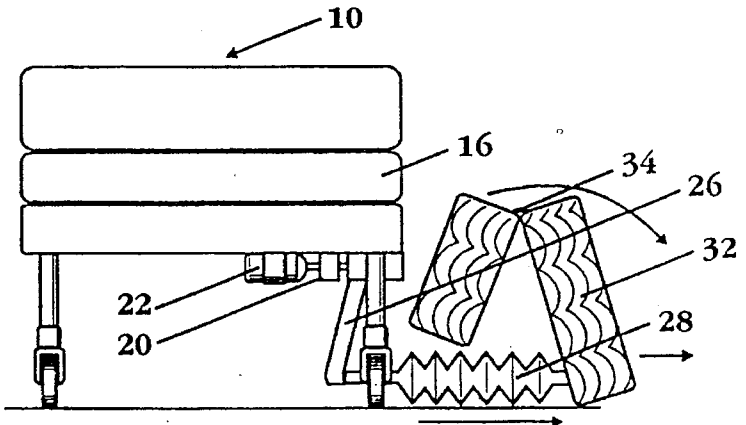
FIG. 3A–C are end views of a patient bed illustrating a further alternate means of deploying an impact cushioning device which prior to activation, is stowed in folded position beside the bed and from there displaced to intervene between falling patient and the floor.

Referring now to the drawings wherein the showings are for the purpose of illustrating preferred embodiments of the present invention only and not for the purpose of limiting the same:

FIG. 1A illustrates a bed 10 constructed in accordance with a first embodiment of the present invention. Bed 10 generally comprises a frame portion 12, head and foot ends 14, and mattress 16.

Figure 4A:
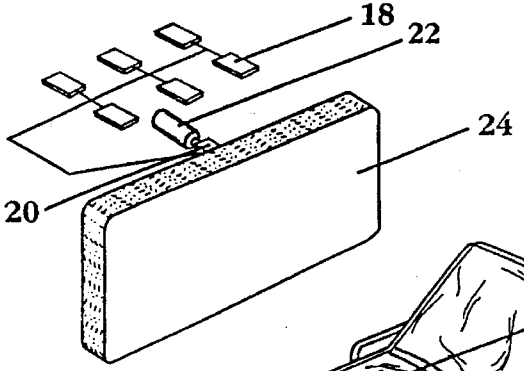
FIG. 4A is a perspective view of the components used to activate the impact cushioning device employed as a means to trigger the activation of the impact cushioning device.
Figure 4B:
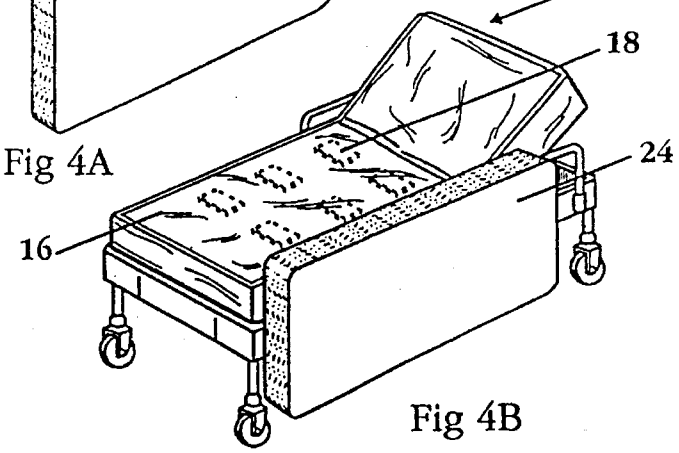
FIG. 4B is a perspective view of the patient bed illustrating the components used to activate the impact cushioning device, in phantom.

Disposed within or positioned upon horizontal mattress 16 are plural weight sensors preferably implemented as one or more pressure sensitive switches 18 which are arranged preferably in a generally rectangular configuration. Referring now to FIG. 4A, pressure sensitive switches 18 are electrically interconnected to each other and to a valve mechanism 20 in a manner whereby switches 18 are enabled to generate a signal to valve mechanism 20 when pressure, i.e. weight is removed from each of the switches 18. Fluidly connected to valve mechanism 20 is a replaceable canister 22 containing therein a supply of compressed gas. Valve mechanism 20 is also fluidly connected to at least one or more impact cushioning pads 24 by one or more connection lines 26 and one or more bellows configurations 28. The valve mechanism 20 is normally closed whereby the compressed gas is retained within canister 22 and operable to an open position whereby the compressed gas is free to flow from canister 22 into connection line 26 and there to bellows 28. When bellows 28 is filled with gas from canister 22, the impact cushioning pad 24 is displaced in a means to intervene between a falling patient and the floor. In this regard the signal generated from pressure sensitive switches 18 is operable to actuate valve mechanism 20 from its normally closed to its open position. Though not shown, bed 10 further includes an on/off switch which is movable between an on position and an off position for selectively activating and deactivating pressure sensitive switches 18. In this respect, the on/off switch is operable to block the signal from pressure sensitive switches 18 to valve mechanism 20 when the switch is in the off position. As can be appreciated, this particular feature is necessary so that when removing bed occupant 30 from bed 10, air cushion 24 is not unnecessarily displaced. Though also not shown, it is further contemplated that valve mechanism 20 will include an audible or visual alarm electronically connected thereto. In this regard, the alarm is activated when valve mechanism 20 actuates to an open position, thereby informing hospital personnel that the occupant 30 has fallen from the bed 10.

Referring now to FIG. 1A & B, illustrated is a first embodiment of the present invention. A patient's bed 10 is constructed or modified to include the impact cushioning device 24 stowed under the mattress 16 of bed 10. When bellows 28 is filled with gas released by valve 20 from canister 22, the impact cushioning device 24 is displaced horizontally and outwardly to form a barrier between the falling patient 30 and the floor.

While both sides of the bed can be thus rigged and protected, in practice the bed 10 occupied by patient at risk of falling 30 can be placed against a wall of the room occupied by patient 30. Thus it is generally necessary to protect only one side of bed 10. In this connection it will be appreciated that injury from falls from the foot of patient bed 10 can be prevented by means of a similar embodiment of canister 22 release valve 20, connecting line 26, bellows 28 and impact cushioning device 24.

Referring now to FIGS. 2A, B, and C, illustrated is a second embodiment of the present invention wherein the cushioning impact device 24 is stowed vertically at the side of patient's bed 10. Upon release of gas from canister 22 into bellows 28 the cushioning impact device 24 is displaced outward and downward from the opposed longitudinal edges of the bed 10.

Figure 3A:
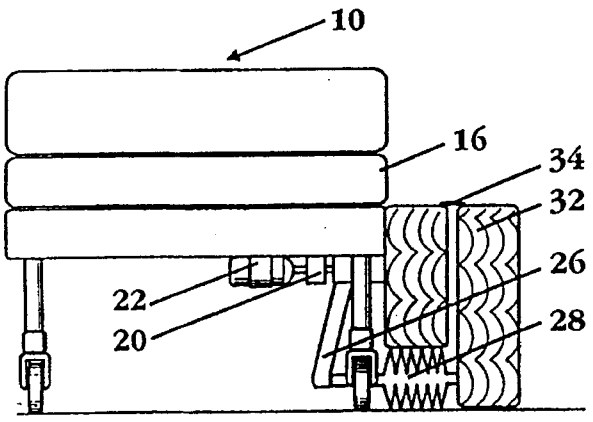
Figure 3C:
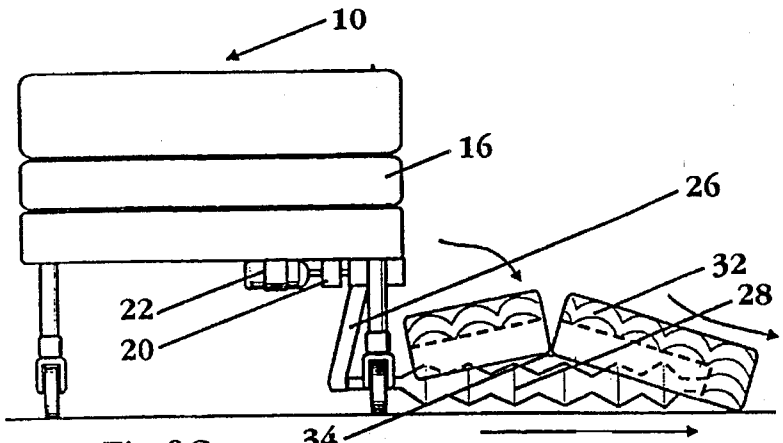

Referring now to FIGS. 3A, B and C, illustrated is a third embodiment of the present invention wherein the cushioning impact device 32 is formed in 2 sections, joined longitudinally by flexible means 34 and stowed vertically at the side of patient's bed 10. Upon release of gas from canister 22 into bellows 28 the cushioning impact device 24 is displaced outward and downward from the opposed longitudinal edges of bed 10.

Additionally, the valve mechanism 20 of the first, second and third embodiment also includes an audio or visual alarm electronically connected thereto, which is activated when the valve mechanism 20 activates to the open position thereby informing medical personnel that the bed occupant has fallen.

Though the present invention has been described as being utilized in conjunction with a patient's bed, it will be appreciated that the present invention may incorporate additional modifications and improvements, to protect against falls from wheelchairs, toilets, as well as ambulation therapy applications. Additionally, either embodiment of the present invention may incorporate a conventional inflation device as currently known and utilized with respect to automobiles.

The particular combination of parts described and illustrated herein is intended to represent only 3 embodiments of the invention and it is not intended to serve as limitations of alternative devices within the spirit and scope of the invention.

What is claimed:

1. An impact cushioning device for protecting a bed occupant from fall-related injuries comprising the combination of:

a bed housing a frame portion and a horizontal mattress portion;

at least one sensing means disposed in or on said mattress portion, said sensing means being operable to generate a signal when the weight of said occupant is removed therefrom;

an impact cushioning device stowed in relationship to said frame portion;

a bellows attached to said impact cushioning device;

inflating means for inflating said bellows, said inflating means being responsive to said signal generated by said sensing means; and a switch for selectively activating and deactivating said sensing means; said impact cushioning device being stowed by said frame portion in a manner wherein said impact cushioning device will displace outwardly from said bed so as to create a barrier between said bed occupant and the floor when said occupant falls from the mattress portion.

2. The device of claim 1 wherein said at least one sensing means comprises a plurality of pressure sensitive switches disposed within or on said mattress portion in a generally rectangular configuration.

3. The device of claim 2 wherein said plurality of pressure sensitive switches are disposed within or adjacent to a mat positioned in or upon said mattress portion.

4. The device of claim 2 wherein said inflating means comprises a canister containing a supply of compressed gas therein, said canister being fluidly connected to a valve mechanism and said valve mechanism being fluidly connected to said bellows and thereby to said input cushioning device.

5. The device of claim 4 wherein said valve mechanism is normally closed whereby said compressed gas is retained within said canister and operable to an open position whereby said compressed gas is free to flow from said canister into said bellows and thereby to displace said impact cushioning device.

6. The device of claim 5 wherein said sensing means is electrically connected to said valve mechanism and said signal is operable to actuate said valve mechanism to said open position, said signal being generated when pressure is removed from each of said plurality of pressure sensitive switches.

7. The device of claim 6 wherein said switch means comprises an on/off switch movable between an on position and an off position, said on/off switch being operable to block said signal from said sensing means to said valve mechanism when in said off position.

8. The device of claim 6 wherein said valve mechanism further includes an alarm electrically connected thereto, said alarm being activated when said valve mechanism actuates to said open position.

9. The device of claim 1 wherein said impact cushioning device comprises a cushion adapted to displace outwardly from at least one longitudinally extending edge of said bed.

* * * * *